US008001921B2

(12) United States Patent
Oshio et al.

(10) Patent No.: US 8,001,921 B2
(45) Date of Patent: Aug. 23, 2011

(54) LIQUID APPLICATION DEVICE AND INKJET RECORDING APPARATUS

(75) Inventors: Naomi Oshio, Kawasaki (JP); Osamu Iwasaki, Tokyo (JP); Yoshinori Nakagawa, Kawasaki (JP); Atsuhiko Masuyama, Yokohama (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 873 days.

(21) Appl. No.: 11/538,263

(22) Filed: Oct. 3, 2006

(65) Prior Publication Data

US 2007/0126835 A1 Jun. 7, 2007

(30) Foreign Application Priority Data

Dec. 6, 2005 (JP) ..... 2005-352507

(51) Int. Cl.
*B05C 11/02* (2006.01)

(52) U.S. Cl. ..... 118/114; 118/300; 118/318; 118/319; 355/18

(58) Field of Classification Search ..... 118/300, 118/318, 319; 355/18
See application file for complete search history.

(56) References Cited

U.S. PATENT DOCUMENTS

| | | | | |
|---|---|---|---|---|
| 2002/0067944 | A1 * | 6/2002 | Lee et al. | 400/624 |
| 2005/0178323 | A1 * | 8/2005 | Iwasaki et al. | 118/206 |
| 2005/0178324 | A1 | 8/2005 | Iwasaki et al. | |
| 2005/0179720 | A1 | 8/2005 | Iwasaki et al. | |
| 2006/0176325 | A1 | 8/2006 | Seki et al. | |
| 2007/0034102 | A1 | 2/2007 | Oshio et al. | |
| 2007/0034152 | A1 | 2/2007 | Nakagawa et al. | |
| 2007/0035592 | A1 | 2/2007 | Oshio et al. | |
| 2007/0035593 | A1 | 2/2007 | Iwasaki et al. | |
| 2007/0070163 | A1 | 3/2007 | Masuyama et al. | |
| 2007/0126835 | A1 | 6/2007 | Oshio et al. | |
| 2007/0126836 | A1 | 6/2007 | Masuyama et al. | |

FOREIGN PATENT DOCUMENTS

| | | |
|---|---|---|
| JP | 8-058069 | 3/1996 |
| JP | 2002-096452 | 4/2002 |
| JP | 2005-254229 | 9/2005 |

* cited by examiner

*Primary Examiner* — Dah-Wei Yuan
*Assistant Examiner* — Albert Hilton
(74) *Attorney, Agent, or Firm* — Fitzpatrick, Cella, Harper & Scinto

(57) ABSTRACT

A liquid application device capable of applying liquid to different size medium includes a transfer device for transferring the medium, a regulating member for regulating a transferring position of the transferred medium, and a liquid applicator including an application member for applying liquid to the medium transferred by the transfer means and a retention member for retaining the liquid in a liquid retention space which is formed by causing the retention member to abut on the application member. In addition, a storage device stores the liquid, a supply channel supplies the liquid in the storage device to the liquid retention space, a collection channel collects the liquid in the liquid retention space into the storage device, and a supply port is formed in the retention member and is connected to the supply channel. Also, a collection port is formed in the retention member and is connected to the collection channel, and a pump generates a flow of liquid in a liquid channel. The supply port is arranged at a position that is closer to the regulating member than the collection port.

12 Claims, 23 Drawing Sheets

LIQUID APPLICATION DEVICE AND INKJET RECORDING APPARATUS

BACKGROUND OF THE INVENTION

1. Field of the Invention

The present invention relates to a liquid application device and an inkjet recording apparatus, and particularly to a liquid application device for applying liquid to a medium for a certain purpose which is, for example, to promote the coagulation of pigment when recording is carried out using an ink which contains the pigment as a coloring material. The present invention also relates particularly to an inkjet recording apparatus which includes a mechanism for applying liquid to a recording medium used in inkjet recording, for a purpose which is, for example, to promote the coagulation of pigment when recording is carried out using an ink containing the pigment as a coloring material.

2. Description of the Related Art

Conventionally, in the printing field, a configuration has been known in which an area where ink as application liquid is supplied to a roller is sealed off (refer to Japanese Patent Application Laid-open No. 8-058069 (1996)). An application mechanism described in this document is a mechanism of applying ink to the roller on whose surface, a printing plate pattern is formed in a gravure printing machine. Therein, the mechanism is configured to use an ink chamber having: doctor blades, which are located in two positions respectively corresponding to upper and lower locations along a circumferential surface of the roller, and which extend in a longitudinal direction of the roller; and elastic members respectively provided to both sides of these two doctor blades. By bringing this ink chamber into contact with the circumferential surface of the roller, a liquid room is formed between the chamber and the roller. Then, by rotating the roller, application liquid in this ink room is applied or supplied to the roller. In Japanese Patent Application Laid-open No. 08-058069 (1996) A, a pump is provided between an ink tank and the application liquid room, and operations such as supply of the application liquid are performed by using a pressurizing system. That is, the pump pumps ink inside the ink tank into the application liquid room under a pressure, and thereby the application liquid is supplied from the ink tank to the application liquid room, and the like.

Additionally, Japanese Patent Application Laid-open No. 2005-254229 proposes a liquid application device in which a sealing property in the above is further enhanced. In the liquid application device, an abutting portion of a liquid retention member is formed of a single member in an annular shape, and abuts on an application roller, thereby forming a liquid retention space for retaining application liquid. In Japanese Patent Application Laid-open No. 2005-254229, an elastic member is exemplified as the application roller abutting the liquid retention member.

In contrast to Japanese Patent Application Laid-open No. 8-058069 (1996), in the liquid application device in Japanese Patent Application Laid-open No. 2005-254229, a pump is provided at the side of a collection port of the liquid retention member, and the application liquid can be supplied, circulated and collected by using a negative pressure (decompression) system (pressure reduction system). In the case of the pressurizing system, liquid leakage may occur since a pressure inside a liquid room increases when a large amount of liquid is supplied to the application liquid room. By use of the negative pressure system, however, such liquid leakage can be reduced. Additionally, although the pressurizing system requires a supply control in which ink consumption by application is taken into consideration, the use of the negative pressure system eliminates the necessity of performing the supply control. Consequently, cost reduction and downsizing can be pursued. Thus, Japanese Patent Application Laid-open No. 2005-254229 has more advantages than Japanese Patent Application Laid-open No. 8-058069 (1996).

However, it is not mentioned in Japanese Patent Application Laid-open No. 2005-254229 that durability is uncertain when the elastic member is used as the application roller.

To be more precise, there has conventionally been a problem that, as the number of rotation times for applying liquid to recording media increases, the roller is more likely to become thinner by being shaved in a portion thereof where the recording media pass. That is, although the application liquid works also as a lubricant when adhering to the surface of the roller, the application liquid is applied to the recording medium by coming into contact with the recording medium. Subsequently, only a small amount of the application liquid is left on a region of the surface of the roller where the recording medium passes. At this time, if the region, where only the small amount of the application liquid is left, enters a nip area of the roller, a frictional force acting on the nip area becomes large.

In a region having no contact with the recording medium, a large amount of the application liquid remains. Consequently, if this region enters the nip area, the frictional force is small because the large amount of remaining application liquid works as a lubricant. On the other hand, in the region (the region having been in contact with the recording media) where only the small amount of application liquid is left, the frictional force becomes large as has been described above, and thereby abrasion of the roller may progress.

This problem is schematically shown in FIGS. 14 and 15. FIG. 15 conceptually shows how a roller 1401, which is shown in FIG. 14, having a predetermined roller diameter becomes after a durability test is given to the roller 1401, and also shows a graph regarding a relationship between the roller diameter and a position in the roller.

In FIGS. 14 and 15, right-hand ends of the drawings are references (a reference for transferring a recording medium) against which a recording medium abuts when the recording medium is transferred. When the recoding medium is transferred, the recording medium is transferred by abutting against the reference provided in a vicinity of an end portion of a device, or in a vicinity of the central portion thereof. Additionally, there are various sizes of recording media such as A4, A5, A3, B5 and B4 in the market. In order to handle these various sizes, a recording apparatus has a maximum width equal to that of recoding media which the recording apparatus supports. For example, in a case of an apparatus having, at a right-hand end thereof, a reference against which a recording medium abuts, frequencies at which recording media pass the roller are apparently different between a reference side of the roller and the other side (a non-reference side) thereof which is opposite to the reference side along a longitudinal direction of the application roller. This is because that recording media of any size pass the reference side of the roller, while some sizes of recording media do not pass the non-reference side thereof.

For this reason, amounts of abrasion of the roller become different between the reference side and the non-reference side. FIG. 14 illustrates an example of a roller of a recording apparatus in which a maximum size of supported recording media (a size of recording media on which the recording apparatus can perform recording) is A3. In a case where a user using this recording apparatus frequently uses the A4 size of recording media, as shown in FIG. 15, degrees at which the roller diameter decreases due to abrasion of the roller are more likely to differ between a part where A4 paper passes (a range 1501), and the other part (a range 1502). That is, a diameter of the part where A4 paper passes (the range 1501) may become thinner than that of the other part (the range 1502).

Additionally, after having filed Japanese Patent Application Laid-open No. 2005-254229, the inventors of the present invention discovered that the abrasion amount is more likely to be increased by a larger negative pressure inside the liquid retention member. FIG. 16 illustrates this discovery.

A pushing pressure of a cap against the roller changes when the diameter of the roller becomes thinner due to abrasion for these reasons. As explicitly mentioned in Japanese Patent Application Laid-open No. 2005-254229, the change of the pushing pressure leads to an unintentional change in the amount of the application. That is, uneven application occurs in a single recoding medium, whereby causing harmful effects on an image when the image is printed out.

Thus, although operations such as supply of application liquid by the negative pressure system have various advantages as has been described above, further contrivance for performing more favorable printing is needed.

SUMMARY OF THE INVENTION

An object of the present invention is to provide a liquid application device and an inkjet recording apparatus, which are capable of reducing harmful effects resulting from an increase in the number of times of using an application member (for example, a roller).

In a first aspect of the present invention, a liquid application device capable of applying liquid to different size medium comprises: transfer means for transferring the medium; liquid application means including an application member for applying liquid to the medium transferred by the transfer means; and a retention member for retaining the liquid in a liquid retention space which is formed by causing the retention member to abut on the application member, the liquid retention means applying the liquid retained in the liquid retention space to the medium via the application member by rotating the application member; a supply port which is formed in the retention member, and which supplies the liquid to the liquid retention space; a collection port which is formed in the retention member, and which causes the liquid to flow out of the liquid retention space; and negative pressure generating means for causing the liquid to flow out of the liquid retention space while the liquid is applied to the medium by the liquid application means, thereby generating a negative pressure in the collection port, the negative pressure of the collection port being larger than that of the supply port, in the liquid retention space, wherein the supply port is formed on a first position of the retention member, the first position being opposite to a second position of the application member in a direction orthogonal to a direction of the transferring, in which the application member abuts medium of all size, and the collection port is formed on a third position of the retention member, the third position being opposite to a fourth position of the application member in the direction orthogonal to the direction of the transferring, in which the application member abuts only medium of a part of all size.

In a second aspect of the present invention, a liquid application device capable of applying liquid to different size medium comprises: transfer means for transferring the medium; liquid application means including an application member for applying liquid to the medium transferred by the transfer means; and a retention member for retaining the liquid in a liquid retention space which is formed by causing the retention member to abut on the application member, the liquid retention means applying the liquid retained in the liquid retention space to the medium via the application member by rotating the application member; storage means which stores the liquid; a supply port which is formed in the retention member, and which supplies the liquid to the liquid retention space; a collection port which is formed in the retention member, and which causes the liquid to flow out of the liquid retention space; a first passage through which the storage means and the supply port communicate with each other; a second passage through which the storage means and the collection port communicate with each other; and circulating means for circulating the liquid in a channel including the storage means, the first passage, the liquid retention space and the second passage by driving a pump arranged in the second passage while the liquid is applied to the medium by the liquid application means; wherein the supply port is arranged at a position relatively close to a reference which is a transferring position of one end of the medium of all size along with a direction of transferring the medium, and the collection port is arranged at a position relatively far from the reference.

In a third aspect of the present invention, a liquid application device capable of applying liquid to different size medium comprises: transfer means for transferring the medium; liquid application means including an application member for applying liquid to the medium transferred by the transfer means; and a retention member for retaining the liquid in a liquid retention space which is formed by causing the retention member to abut on the application member, the liquid retention means applying the liquid retained in the liquid retention space to the medium via the application member by rotating the application member; a supply port which is formed in the retention member, and which supplies the liquid to the liquid retention space; a collection port which is formed in the retention member, and which causes the liquid to flow out of the liquid retention space; negative pressure generating means for causing the liquid to flow out of the liquid retention space while, the liquid is applied to the medium by the liquid application means, thereby generating a negative pressure in the collection port, the negative pressure being larger than that of the supply port, in the liquid retention space; and wherein the supply port is arranged at a position relatively close to a reference position which is a reference of a transferring position of the medium of all size, and the collection port is arranged at a position relatively far from the reference position.

In a fourth aspect of the present invention, an inkjet recording apparatus comprises: the liquid application device according to claim 1; and recording means for recording an image on a medium by ejecting ink from a recording head to the medium to which liquid has been applied by the liquid application device.

In a fifth aspect of the present invention, a recording apparatus comprises: the liquid application device according to claim 1; and recording means for recording an image on a medium by applying a recording agent to the medium to which liquid has been applied by the liquid application device.

According to the present invention, the collection port is arranged at a position relatively far from a transferring reference while the supply port is arranged at a position relatively close to the transferring reference. Accordingly, it is possible to disperse an influence from abrasion of the application member (for example, an application roller) due to a negative pressure. Consequently, harmful effects on an image which result from abrasion of the application member can be suppressed.

Further features of the present invention will become apparent from the following description of exemplary embodiments (with reference to the attached drawings).

DESCRIPTION OF THE EMBODIMENTS

Detailed description will be given below of a preferred embodiment of the present invention with reference to the accompanying drawings.

Figure 1:
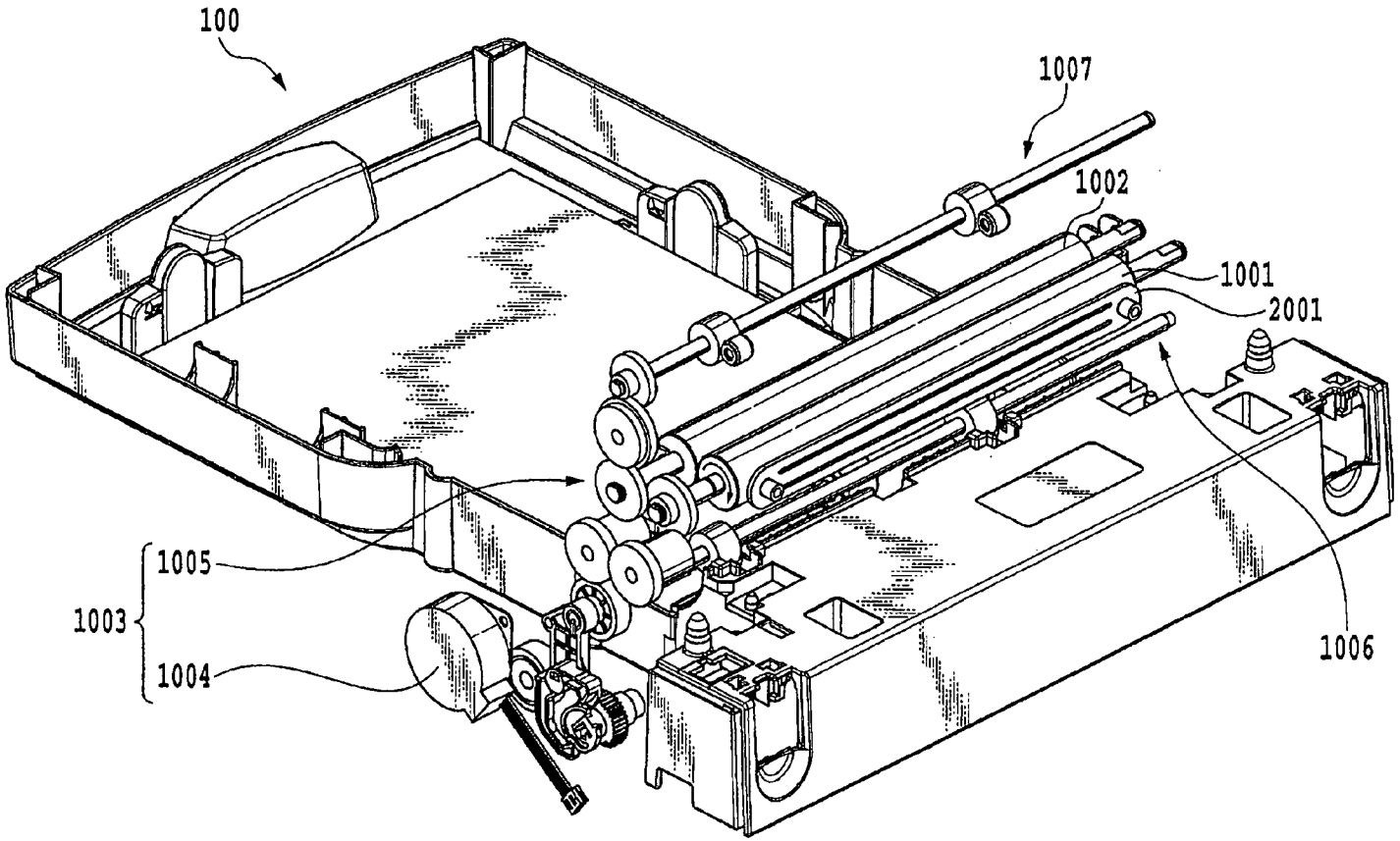
FIG.1 (PRIOR ART)
FIG. 1 is a perspective view showing an overall construction of an embodiment of a liquid application device of the present invention.

FIG. 1 is a perspective view showing an overall structure of the embodiment of a liquid application device 100 of the present invention. The liquid application device 100 shown here generally includes liquid application means for applying a predetermined application liquid to a medium (hereinafter also referred to as the application medium) which is an object to which the liquid is applied and liquid supply means for supplying the application liquid to the liquid application means.

The liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIG. 1), to be described later, supplying the liquid to the liquid retention member 2001. The application roller 1001 and the counter roller 1002 are freely rotatably supported individually by parallel shafts, each of which has both ends thereof freely rotatably fitted to a frame not shown. The liquid retention member 2001 extends substantially over the entire length of the application roller 1001, and is movably mounted to the frame via a mechanism which enables the liquid retention member 2001 to come into contact with or to separate from the circumferential surface of the application roller 1001.

The liquid application device of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

It should be noted that the application liquid used in this embodiment is a liquid used for the purpose of advancing the start of the coagulation of pigment when recording is carried out using an ink which contains pigment as a coloring material.

An example of components of the application liquid is described below.

| | |
|---|---|
| calcium nitrate tetrahydrate | 10% |
| glycerin | 42% |
| surface-active agent | 1% |
| water | the rest |

The viscosity of the application liquid is from 5 to 6 cP (centipoises) at 25° C.

Needless to say, in application of the present invention, the application liquid is not limited to the above liquid. As another application liquid, for example, a liquid which contains a component insolubilizing the dye or causing the coagulation of the dye, can be used. As yet another application liquid, a liquid which contains a component suppressing curling of the application media (the phenomenon that the media take a curved shape), can be used.

In a case where water is used in the applied liquid, the sliding property at the contact area of the liquid retention member with the application roller of the present invention will be improved by mixing a component reducing the surface tension with the liquid. In the above example of the components of the applied liquid, glycerin and the surface-active agent are the components reducing the surface tension of water.

More detailed description will now be given of construction of each portion.

Figure 2:
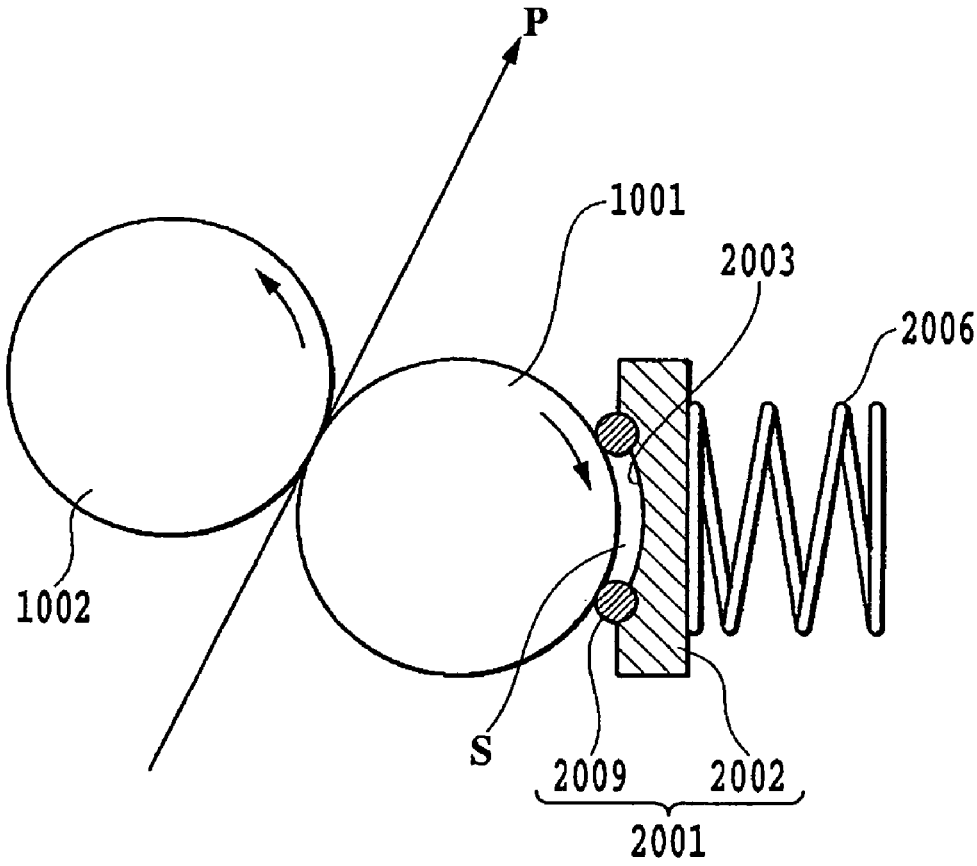
FIG.2 (PRIOR ART)
FIG. 2 is a longitudinal sectional side view showing an example of an arrangement of elements including an application roller, a counter roller and a liquid retention member.

FIG. 2 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means not shown, and rotates the application roller 1001 clockwise in the figure. This rotation makes it possible to hold, between both rollers, the application medium P to which the application liquid is applied, and to transfer the application medium P in the direction indicated by the arrow in the figure.

The liquid retention member 2001 is designed to create an elongated liquid retention space S extending across a liquid application region of the application roller 1001 while the liquid retention member 2001 abuts on the circumferential surface of the application roller 1001, biased thereto by the bias force of a spring member (pressing means) 2006. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 3 to 8.

Figure 3:
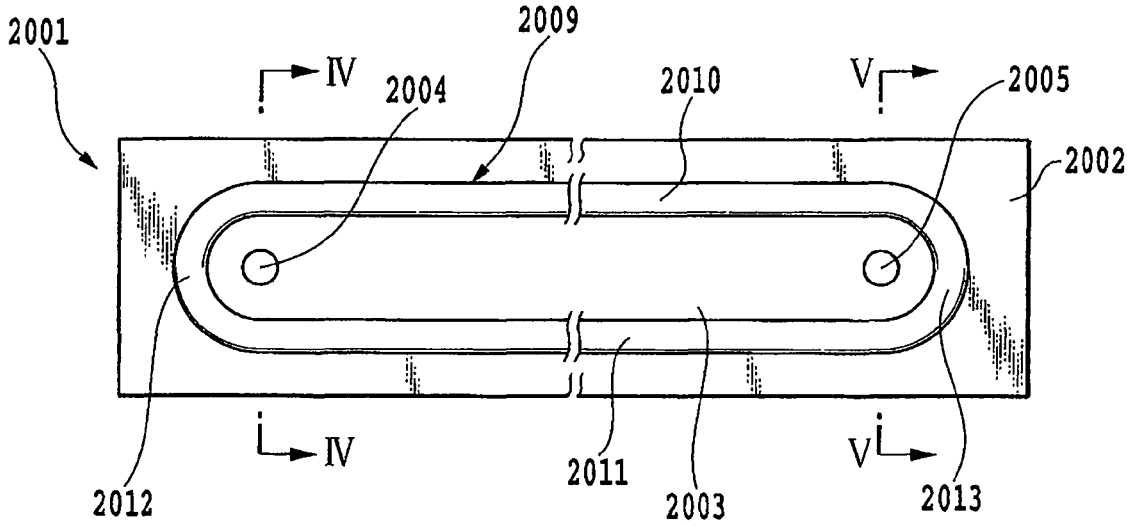
FIG.3 (PRIOR ART)
FIG. 3 is a front view of the liquid retention member shown in FIGS. 1 and 2.

As shown in FIG. 3, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space . Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid can go past the contact member 2009 in such a manner as to pass through the interface between the outer circumferential surface of the application roller 1001 and the contact member 2009, and adhere the outer circumferential surface of the application roller like layer. "While the application roller 1001 is stopped, the outer circumferential surface thereof and the contact member 2009 are in a fluid-tight state" means that, as described above, the liquid is not allowed to pass through the boundary between the inside and the outside of the space. In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 4:
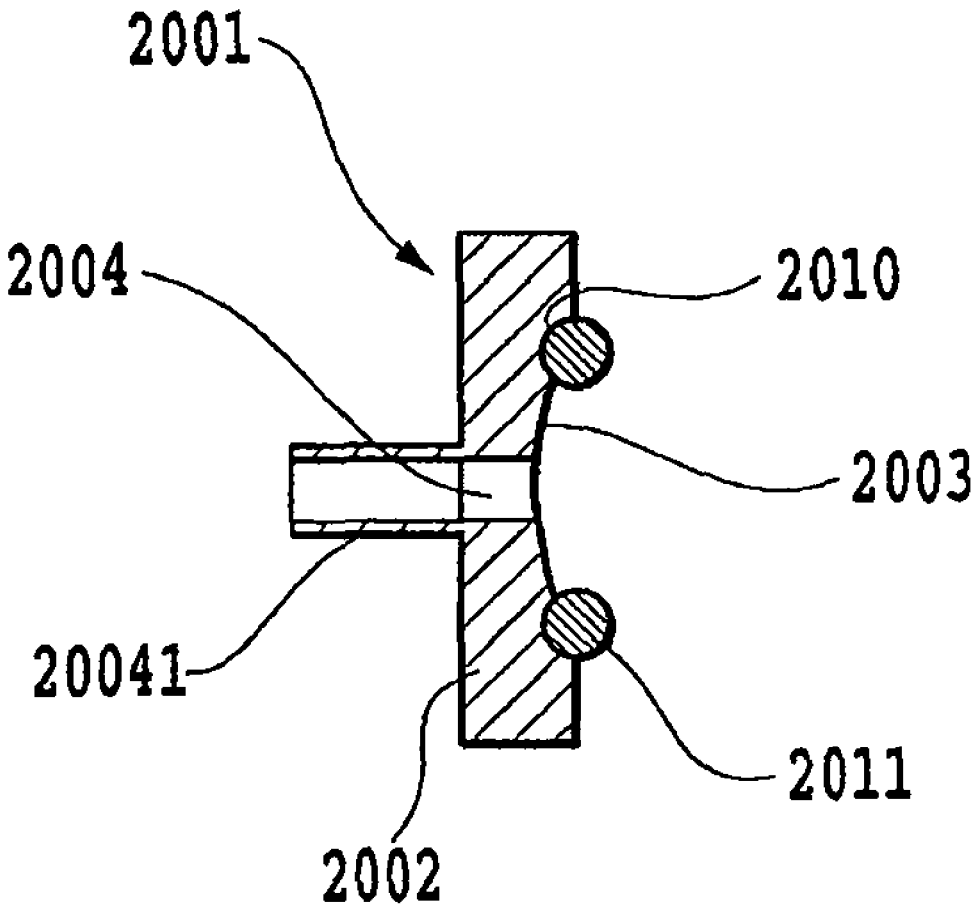
FIG.4 (PRIOR ART)
FIG. 4 is an end view showing an end obtained by cutting the liquid retention member shown in FIG. 3 along the line IV-IV.
Figure 5:
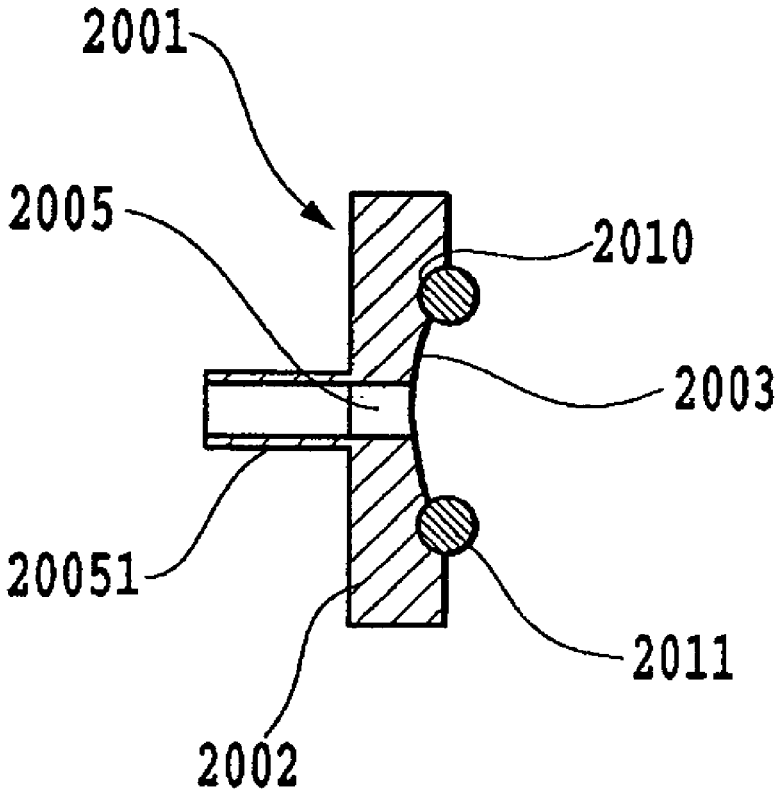
FIG.5 (PRIOR ART)
FIG. 5 is an end view showing an end obtained by cutting the liquid retention member shown in FIG. 3 along the line V-V.
Figure 6:
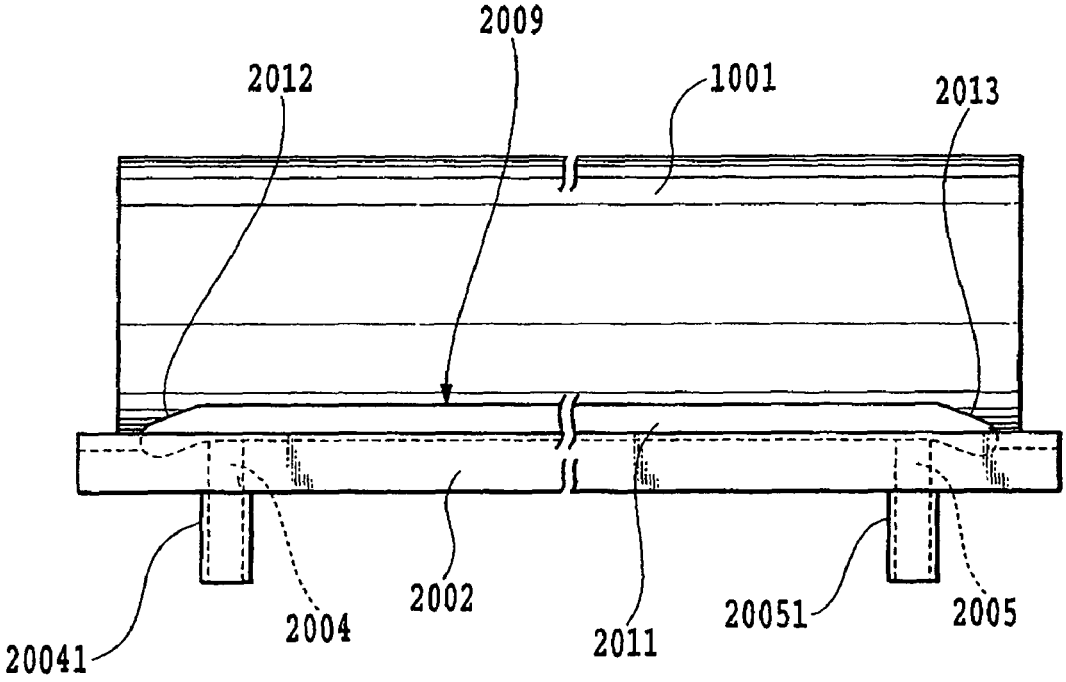
FIG.6 (PRIOR ART)
FIG. 6 is a plan view of the liquid retention member shown in FIG. 3.
Figure 7:
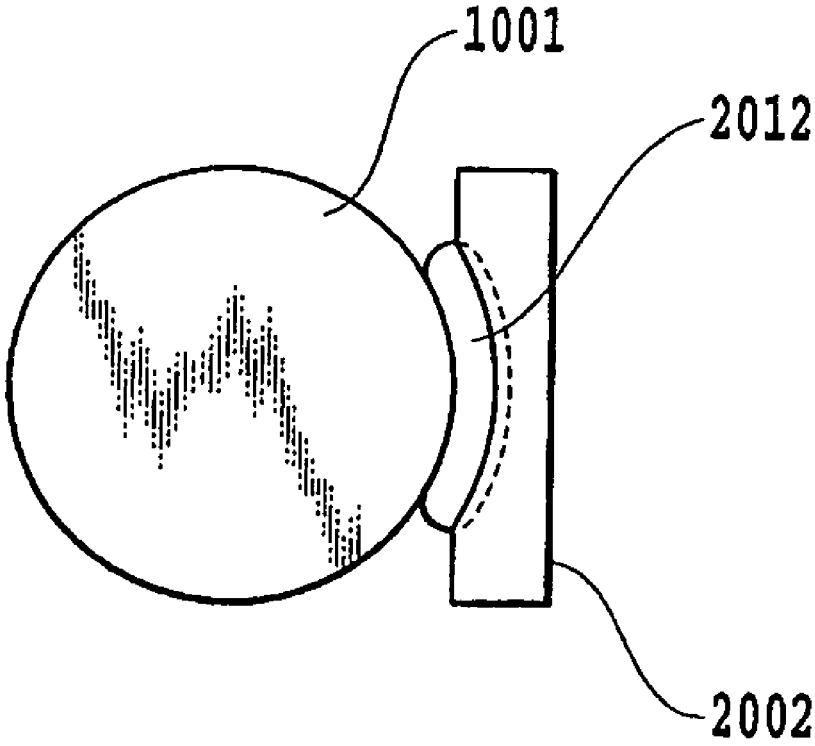
FIG.7 (PRIOR ART)
FIG. 7 is a left side view showing a state where a contact portion of the liquid retention member shown in FIG. 3 is allowed to abut on the liquid application roller.
Figure 8:
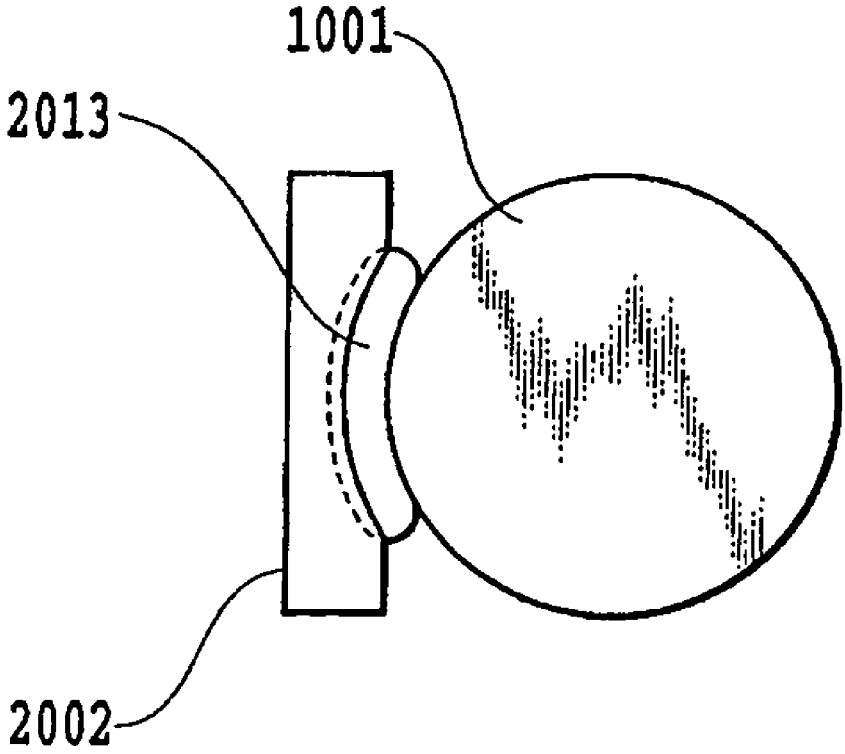
FIG.8 (PRIOR ART)
FIG. 8 is a right side view showing a state where the contact portion of the liquid retention member shown in FIG. 3 is allowed to abut on the liquid application roller.

The left and right end portions of the contact member 2009 in the longitudinal direction have a gently curved shape when viewed from any one of the front thereof (FIG. 3), the top thereof (FIG. 6), and a side thereof (FIGS. 7 and 8), as shown in FIGS. 3 to 8. As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 6 to 8.

On the other hand, as shown in FIGS. 3 to 5, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 3) of the region surrounded by the contact member 2009, and the liquid collection port 2005 is provided near the other end portion (the right end portion in FIG. 3) of the same region.

The liquid supply port and the liquid collection port are not limited by the above configuration, and may be formed at any location in the space creating base. In addition, the number of the liquid supply ports and the number of the liquid collection ports may be arbitrary. The liquid supply port 2004 is used to supply, to the above-described liquid retention space S, the application liquid supplied from the liquid channel 3000. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

Figure 17:
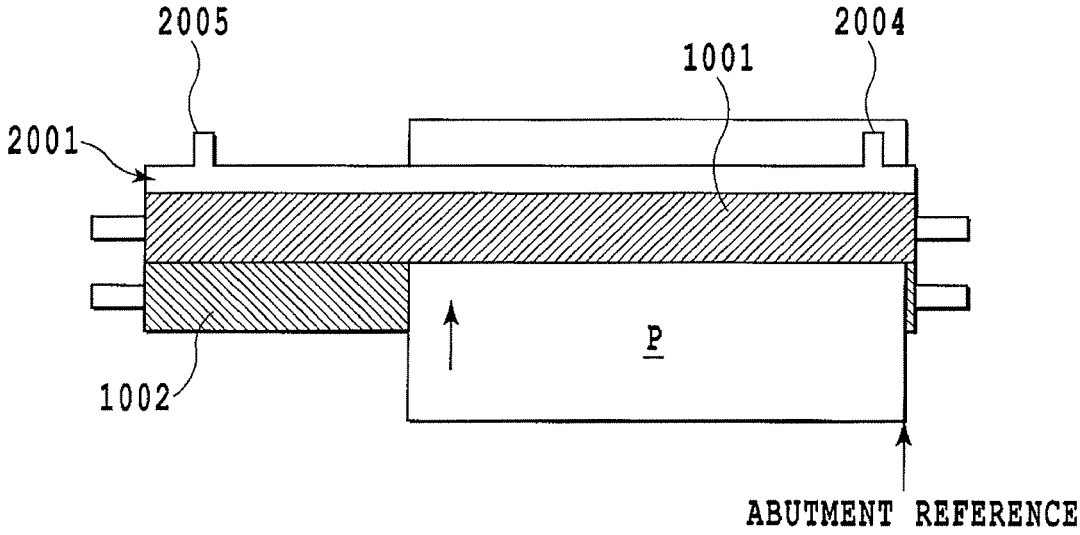
FIG. 17 is a diagram explaining positional relationships of a supply port and a collection port with a reference.

At that time, while the application liquid is flowing inside the liquid retention space S, a pressure loss is caused. For this reason, a negative pressure at the liquid collection port 2005 becomes high in a case of comparing the liquid supply port 2004 with the liquid collection port 2005. Considering that the abrasion amount becomes larger in a part where a negative pressure is higher as has been described above, the collection port 2005 becomes worse in a degree of abrasion, that is, suffers a large amount of abrasion, in comparing the liquid supply port 2004 with the liquid collection port 2005. In the present embodiment, locations of the supply port 2004 and the collection port 2005 are arranged in consideration of a transfer path in the device. Specifically, in order not to accelerate abrasion on a reference side where an application medium is frequently transferred, the collection port 2005 is arranged relatively far from the reference side as compared to the supply port 2004. That is, an end portion, where application media pass at a low frequency in comparison with the reference side, and which suffers less abrasion than the reference side, is arranged in a vicinity of the collection port suffering a large amount of abrasion due to the negative pressure. Thereby, the causes of abrasion are dispersed, and harmful effects on an image due to abrasion of the roller are reduced. For example, in an overview of the device in FIG. 1, a right side of the application roller 1001 viewed from a paper-feeding side is set to the reference side at the time of transfer. At this time, the supply port 2004 is similarly arranged on the right side viewed from the paper-feeding side, and the collection port 2005 is arranged on the non-reference side (on the left side) viewed from the paper-feeding side (FIG. 17).

In this description, "a reference (also referred to as an abutment reference) or a reference point" is a positional reference for an application medium, for example, when the application medium is passed through a nip area between application means such as the application roller 1001 and the counter roller 1002. Thus, the application medium is transferred through the nip area with a predetermined location of the application medium being aligned with the above-mentioned reference. For example, in a case where the reference is set on the right-hand side in FIG. 17, application media of any size are transferred with the end on the right-hand side in a direction of transferring the application media being aligned with the reference. Locating a member for regulating one end portion of the recording medium along with the transferring direction on the right-hand side allows the recording medium to transfer along with right-end of the recording medium.

Figure 18:
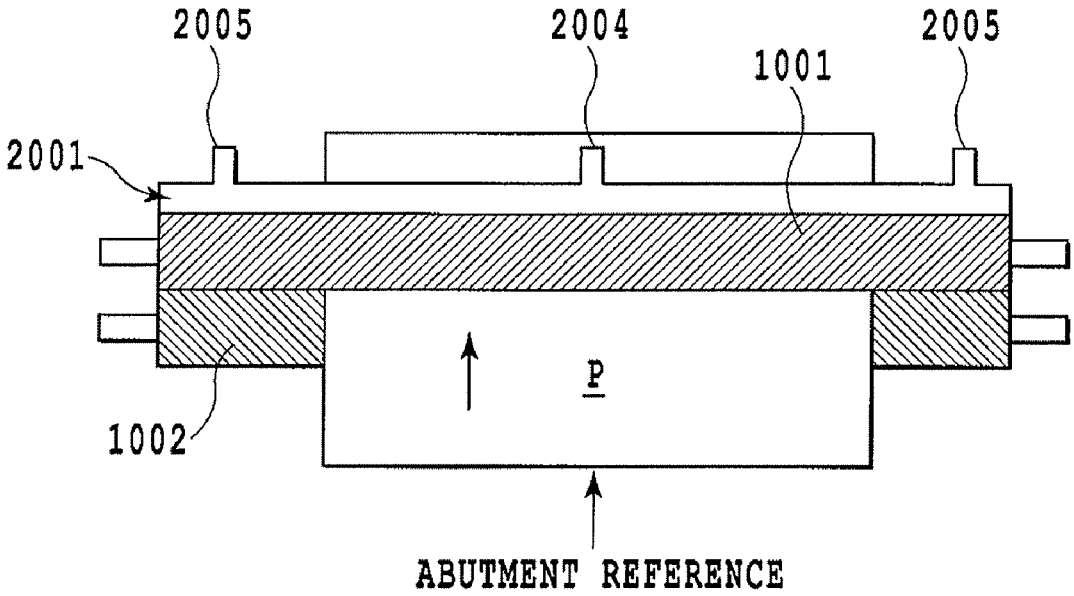
FIG. 18 is a diagram explaining positional relationships of a supply port and a collection port with a reference.

Additionally, for example, in a case where the reference is set at the substantial center in FIG. 18, application media of any size are transferred with the substantial center of the application media being aligned with the reference. Consequently, a transfer path for transferring an application medium from a paper-feeding portion to the application roller is provided so that the application medium can be transferred with a predetermined location of the application medium (the end of the right-hand side of the application medium in FIG. 17) being aligned with the reference.

Thus, a point (a region) aligned with the abovementioned reference in the application media is determined in accordance with the set reference. Note that, the reference is set at the time of designing the device. Based on the reference, provided are a transfer path for causing an application medium to be transferred along the above-mentioned reference, a control mechanism therefor and the like.

As mentioned above, the application media inevitably pass in the vicinity of the reference or the reference point on the application means such as the application roller. On the other hand, depending on sizes of application media, some application media do not pass at the non-reference side (a region far from the reference-side with a predetermined distance along the longitudinal direction of the application means) such as the vicinity of the collection port 2005.

(Application Liquid Channel)

Figure 11:
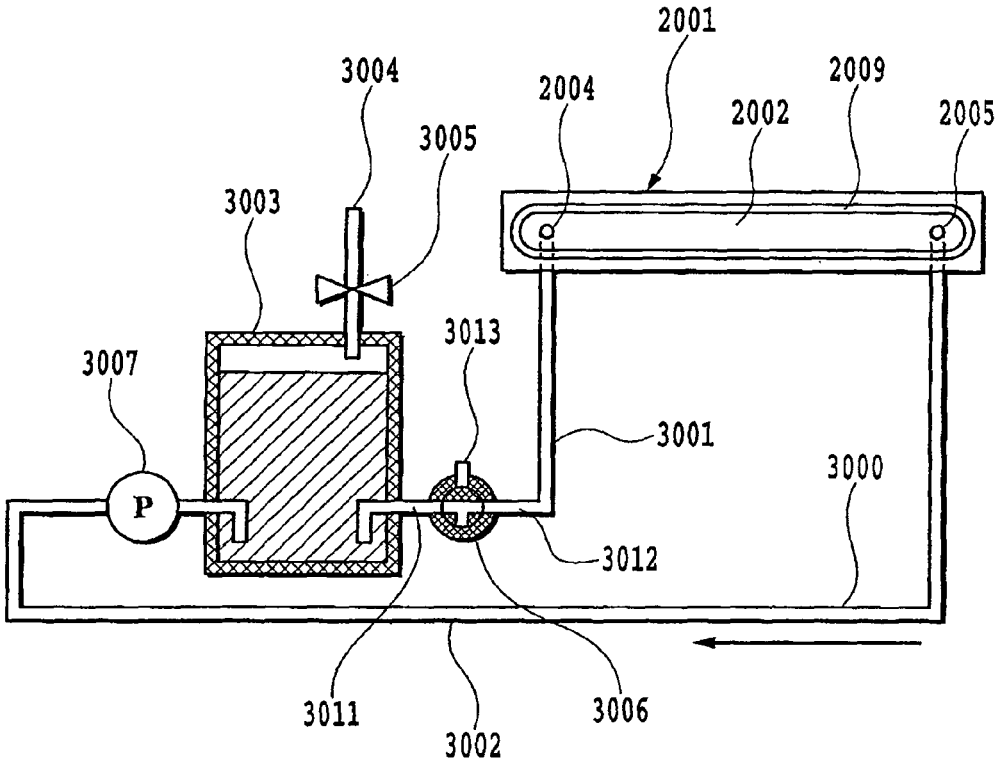
FIG.11 (PRIOR ART)
FIG. 11 is a diagram showing a schematic configuration of a liquid channel of the liquid application device in the embodiment of the present invention.

FIG. 11 is an explanatory diagram showing a schematic configuration of the liquid channel 3000 connected to the liquid retention member 2001 of the application liquid supply means.

The liquid channel 3000 has a first channel 3001 which connects the liquid supply port 2004 of the space creating base 2002 being an element of the liquid retention member 2001, and a storage tank 3003 storing the application liquid. In addition, the liquid channel 3000 has a second channel 3002 which connects the liquid collection port 2005 of the space creating base 2002 and the storage tank 3003. This storage tank 3003 is provided with an atmosphere communication port 3004, and the atmosphere communication port is provided with an atmosphere communication valve 3005 switching between an atmosphere communicating state and an atmosphere isolation state. The atmosphere communication port 3004 preferably has a labyrinth structure in order to suppress vaporization. In addition, a switching valve 3006 is provided in the first channel 3001, making it possible to switch between the state where the first channel 3001 and the atmosphere communicate with each other and the state where these are isolated from each other. In the second channel 3002, a pump 3007 is connected, which is used to force the application liquid and air to flow in a desired direction in the liquid channel 3000.

Note that, the reference point is set at a position on the left-hand side in FIG. 11, so that the distance between the reference point and the collection port 2005 is longer than the distance between the reference point and the supply port 2004. That is, while the supply port 2004 is arranged at a position relatively close to the reference point, the collection port 2005 is arranged at a position relatively far from the reference point.

Additionally, a pump 3007 is arranged inside a second channel 3002 which is a collection channel. Consequently, if the pump 3007 is operated in a way that the application liquid flows in a direction indicated by the arrow in FIG. 11, at least one of air and the application liquid inside the liquid retention space S moves from the collection port 2005 to the second channel 3002, and thereby a negative pressure relative to the atmospheric pressure is developed in an inside of the liquid retention member 2001. Consequently, in the present embodiment, the application liquid is circulated, supplied and collected by using the negative pressure system. When the pump 3007 is driven, a negative pressure of the collection port 2005 is larger than a negative pressure of the supply port 2004, in the liquid retention space S. Accordingly, circulation, supply, and collection of the application liquid are performed in a state where the negative pressure of the collection port 2005 is larger than that of supply port 2004.

For the switching valve 3006 in this embodiment, various kinds of valves can be used as long as the valve can switch between the state where the first channel 3001 and the atmosphere communicate with each other and the state where these are isolated from each other. In this embodiment, however, a three-way valve as shown in FIG. 11 is used. The three-way valve 3006 has three ports communicating with each other. The three-way valve 3006 can allow two of these ports to selectively communicate with two of a storage-tank side tube 3011, a liquid-retention-member side tube 3012 and an atmosphere communication port 3013 in the first channel 3001. The switching of this three-way valve 3006 allows for the selective switching between a connection state where the tubes 3011 and 3012 are allowed to communicate with each other and a connection state where the tube 3012 and the atmosphere communication port 3013 are allowed to communicate with each other. In this way, it is made possible to selectively supply, to the liquid retention space S created by the liquid retention member 2001 and the application roller 1001, the application liquid in the storage tank 3003 or the air taken in from the atmosphere communication port 3013. The switching of the three-way valve 3006 is performed in accordance with a control signal from a below-described control unit 4000, so that the filling or the supply of the application liquid is performed.

(Control System)

Figure 12:
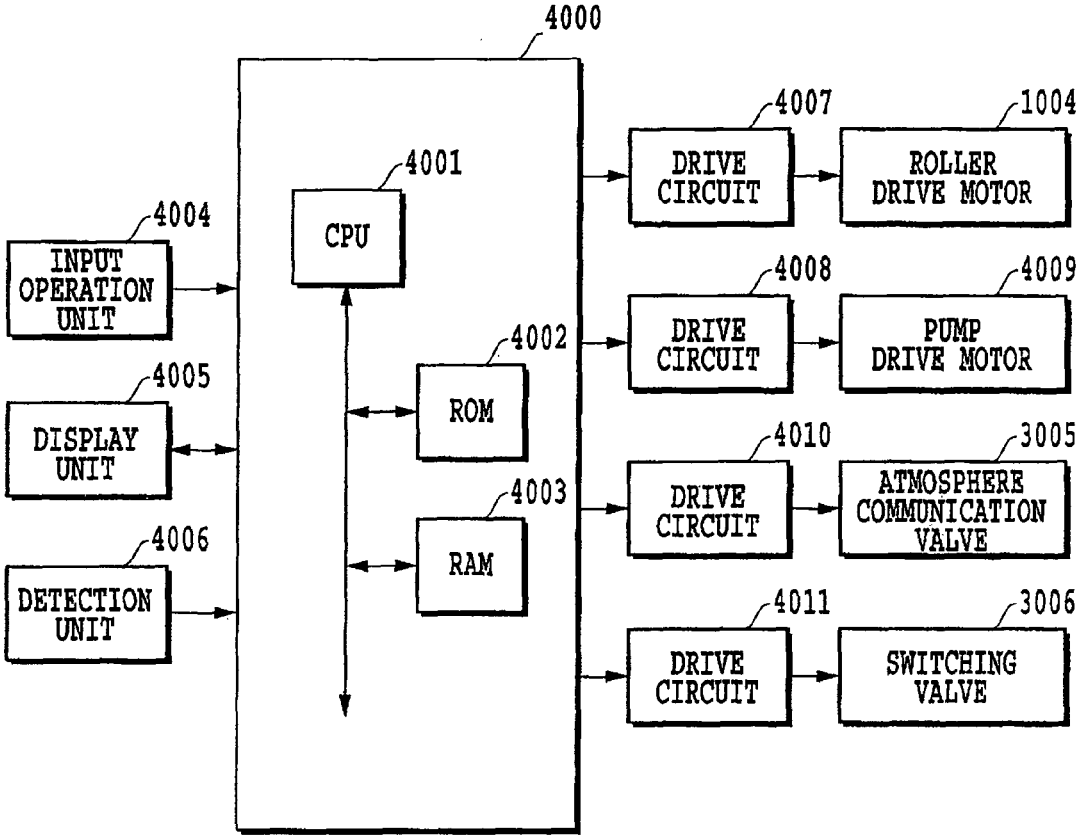
FIG.12 (PRIOR ART)
FIG. 12 is a block diagram showing a schematic configuration of a control system in the embodiment of the present invention.

FIG. 12 is a block diagram showing a schematic configuration of a control system in the liquid application device of the present embodiment.

In FIG. 12, reference numeral 4000 is a control unit as control means for controlling the whole liquid application device. This control unit 4000 includes: a CPU 4001 which performs various processing operations, such as arithmetic, control, and determination; and a ROM 4002 in which stored are a control program and the like for processes described later by referring FIG. 13. The control unit 4000 further includes a RAM 4003, where input data and data under processing by the CPU 4001 are temporarily stored, and the like.

Both of an input operation unit 4004 and a display unit 4005 are connected to this control unit 4000. The input operation unit 4004 includes a keyboard or various switches with which a predetermined command, data or the like is inputted. The display unit 4005 displays various information such as states of input, settings or the like in the liquid application device. Additionally, a detection unit 4006 is connected to the control unit 4000. The detection unit 4006 includes a sensor for detecting a position of an application medium, the operation status of each portion, or the like. Moreover, the roller drive motor 1004, a pump drive motor 4009, the atmosphere communication valve 3005, the switching valve 3006 are connected to the control unit 4000 via drive circuits 4007, 4008, 4010 and 4011, respectively.

(Liquid Application Operation Sequence)

Figure 13:
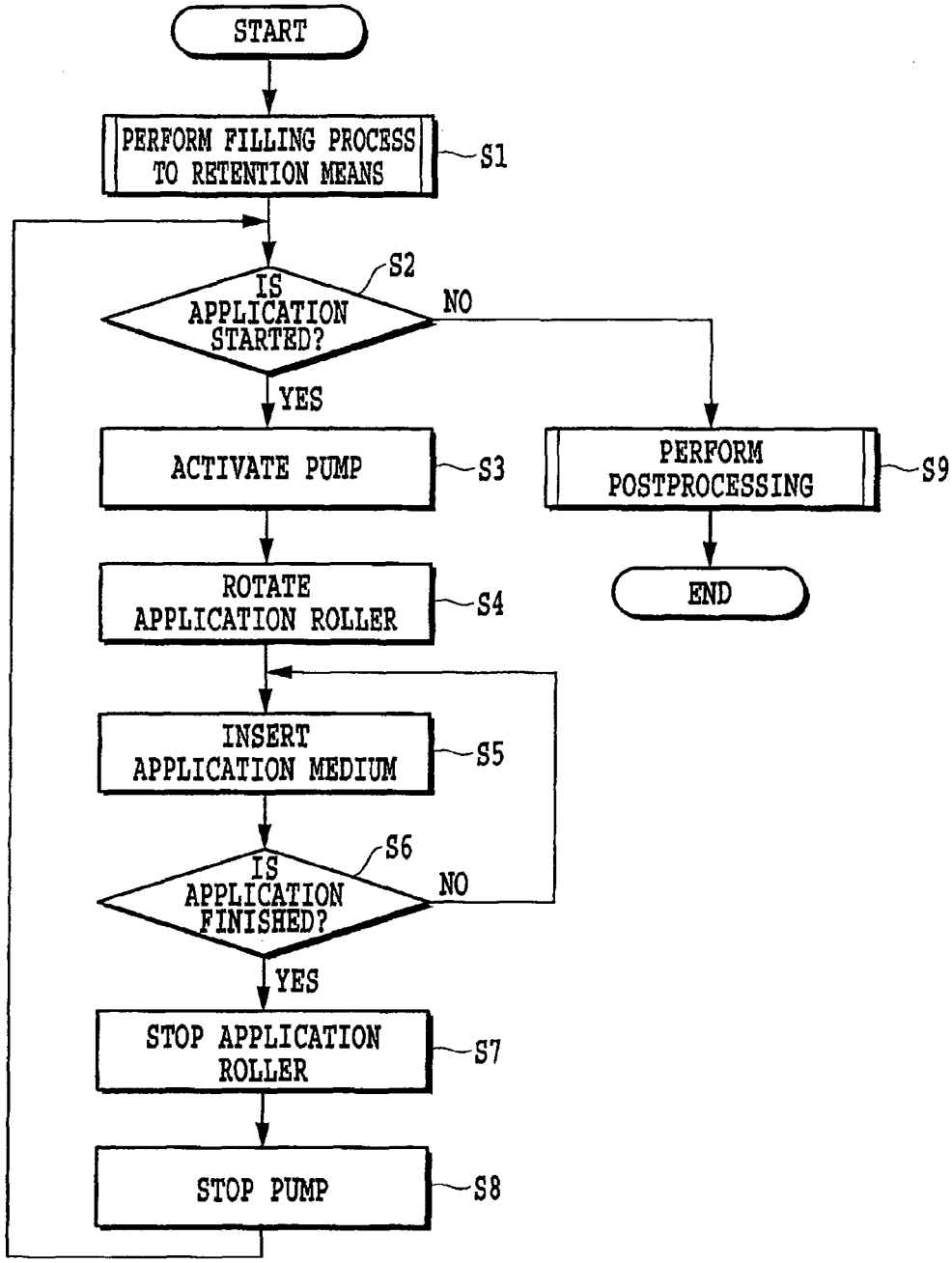
FIG.13 (PRIOR ART)
FIG. 13 is a flow chart showing a liquid-application operation sequence in the embodiment of the present invention.
Figure 14:
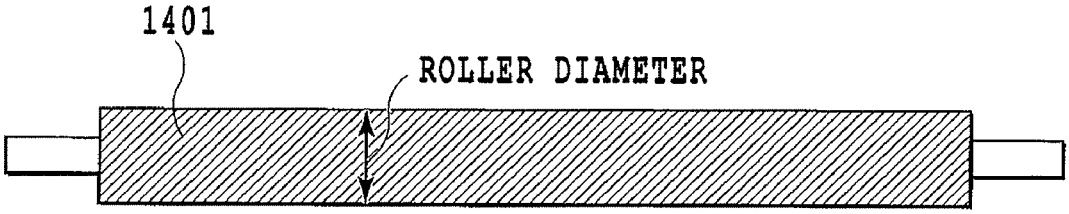
FIG. 14 is a diagram explaining abrasion of a roller resulting from a decrease in liquid remaining on a surface of the roller in a conventional case.
Figure 15:
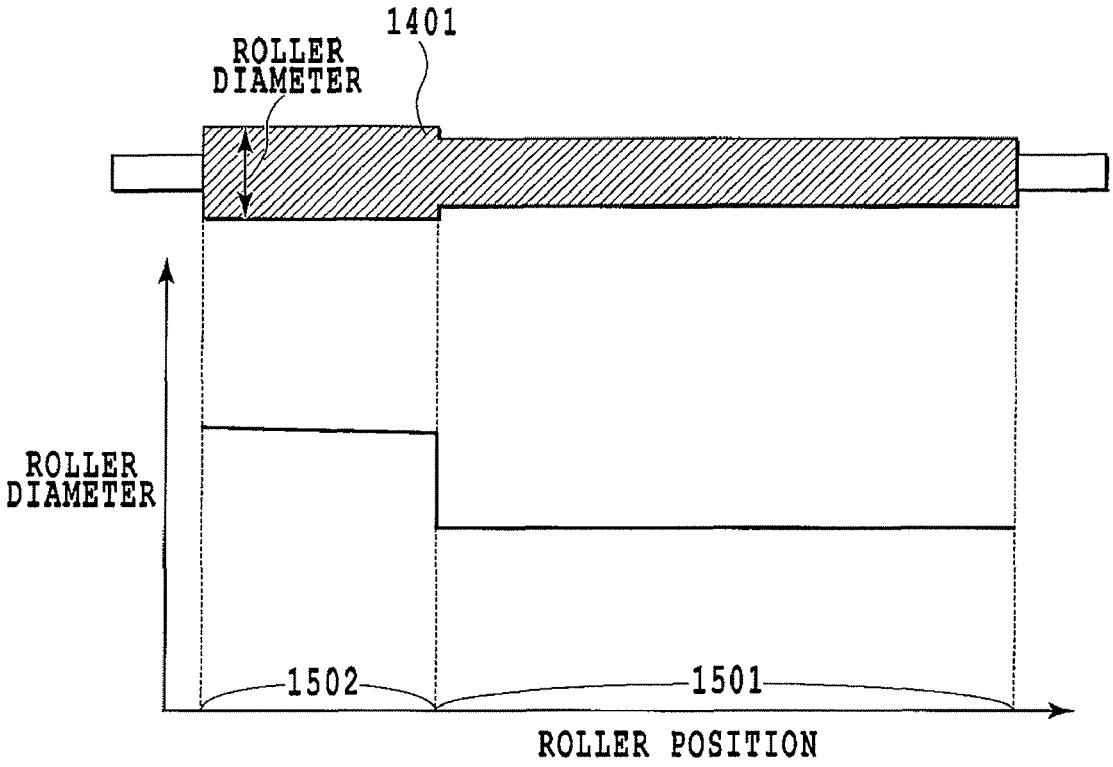
FIG. 15 is a diagram explaining the abrasion of the roller resulting from the decrease in the liquid remaining on the surface of the roller in the conventional case.
Figure 16:
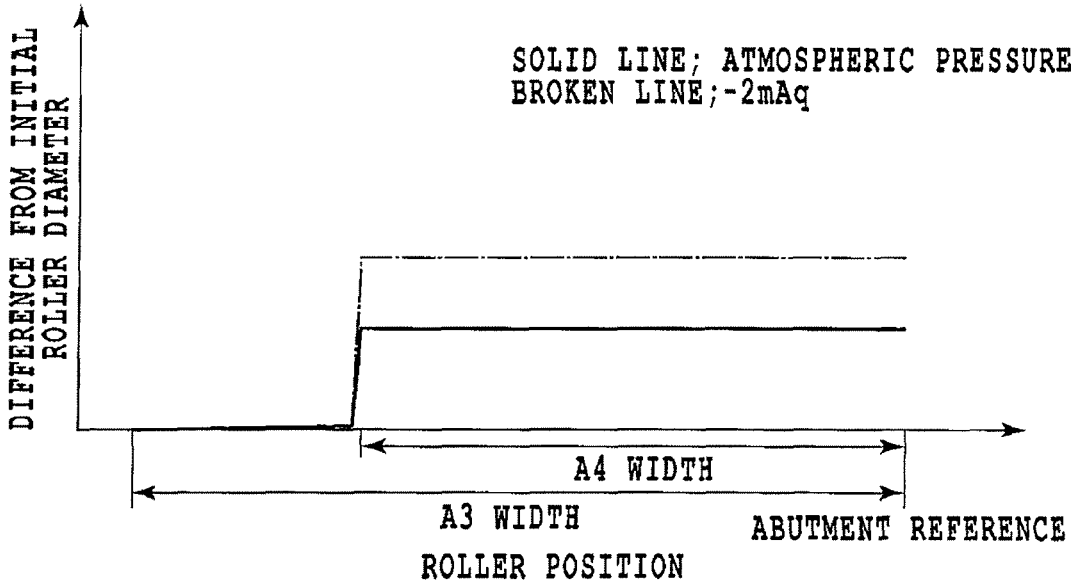
FIG. 16 is a diagram showing that a diameter of the application roller becomes different due to a difference in pressures in a liquid retention portion in a conventional case.

FIG. 13 is a flow chart showing a procedure relating to liquid application by the liquid application device of the present embodiment. A description will be given below of each of the steps relating to the liquid application with reference to this flow chart. That is, once the liquid application device is powered on, the control unit 4000 carries out the following application operation sequence in accordance with the flow chart shown in FIG. 13.

Filling Step

In step S1, a step of filling the application liquid into the liquid retention space S is carried out. In this filling step, first of all, the atmosphere communication valve 3005 of the storage tank 3003 is opened to the atmosphere. At the same time, the pump 3007 is driven during a certain period of time. Thereby, in a case where the application liquid has not been filled in the liquid retention space S and the respective channels 3001 and 3002, the inside air is sent to the storage tank 3003 by the pump 3007 and discharged to the atmosphere, and thereby the application liquid is filled into these respective portions. Moreover, in a case where the application liquid has already been filled in the respective portions, the application liquid in the respective portions flows, and the application liquid having proper concentration and viscosity is supplied. This initial operation results in a state where the application liquid has been supplied to the application roller 1001, making it possible to apply the liquid to an application medium.

Application Step

At this point, if an application start command is inputted (step S2), and the pump 3007 again starts to operate (step S3). Thus, the application liquid is circulated in the liquid channel in a state where the negative pressure of the collection port 2005 is larger than that of supply port 2004. Then, the application roller 1001 starts to rotate clockwise as shown by the arrow in FIG. 1, while the application liquid is circulated in the liquid channel (step S4). With this rotation of the application roller 1001, the application liquid L filled in the liquid retention space S overcomes the pressing force of the contact member 2009 of the liquid retention member 2001 against the application roller 1001, and passes through the interface between the application roller 1001 and a lower edge portion 2011 of the contact member 2009. The application liquid L having passed therethrough adheres to the outer circumference of the application roller 1001 in a laminar manner. The application liquid L adhering to the application roller 1001 is sent to a contact portion between the application roller 1001 and the counter roller 1002.

Figure 9:
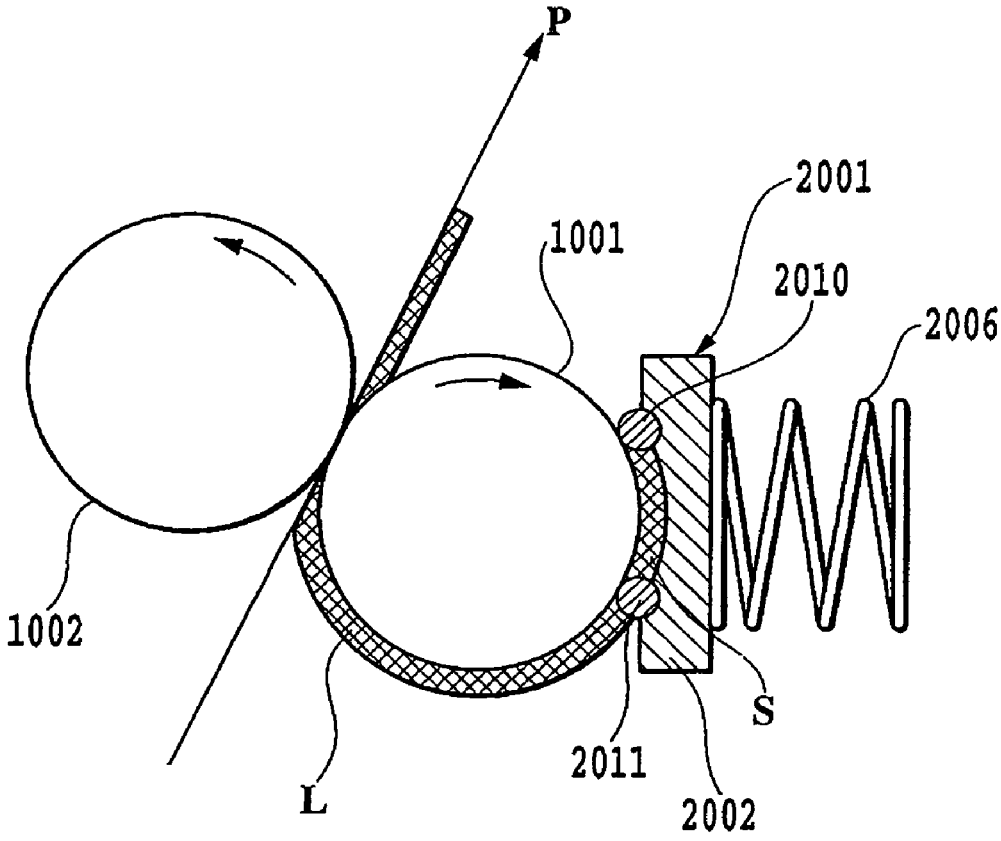
FIG.9 (PRIOR ART)
FIG. 9 is a longitudinal sectional view showing a state where a liquid retention space created by the liquid retention member and the application roller is filled with an application liquid, and the liquid is applied to an application medium as the application roller rotates in the embodiment of the present invention.

Subsequently, the application medium feeding mechanism 1006 transfers an application medium to the interface between the application roller 1001 and the counter roller 1002, and inserts the application medium between these rollers. The inserted application medium is then transferred toward the delivery unit with rotations of the application roller 1001 and the counter roller 1002 (step S5). During this transfer, the application liquid having been applied to the outer circumferential surface of the application roller 1001 is transferred from the application roller 1001 to the application medium P as shown in FIG. 9. Note that, obviously, means for feeding the application medium to the interface between the application roller 1001 and the counter roller 1002 is not limited to the above feeding mechanism. For example, manual feeding means accessorily utilizing a predetermined guide member may be additionally used, or any other means, such as a configuration where only the manual feeding means is used, may be used.

In this embodiment, as above-mentioned, the application of the application liquid by the application roller 1001 is performed, while the application liquid is circulated in the negative pressure system by driving the pomp 3007. Accordingly, in the application of the application liquid, the negative pressure of the collection port 2005 is larger than that of the supply port 2004, in the liquid retention space S. This difference of negative pressure results in a difference for an amount of the abrasion of the application roller. The amount of the abrasion of the application roller caused by the difference of the negative pressure of the collection port 2005 is larger than that of the supply port 2004.

Accordingly, in this embodiment, the supply port 2004 in which an amount of the abrasion caused by the negative pressure is relatively small is located on the transferring reference side in which a transferring frequency of the recording medium is relatively large. In addition, the collection port 2005 in which an amount of the abrasion caused by the negative pressure is relatively large is located on the non-reference side in which the transferring frequency of the recording medium is relatively small. That is, the collection port 2005 is arranged at a position relatively far from the transferring reference position as compared with a position at which the supply port 2004 is arranged. Thus, locating the supply port 2004 in which the amount of the abrasion caused by the negative pressure is small, on the side in which the amount of the abrasion caused by transferring is large, and locating the collection port 2005 in which the amount of the abrasion caused by the negative pressure is large, on the side in which the amount of the abrasion caused by transferring is small allow the left side and the right side of the application roller to relatively even up.

In FIG. 9, the cross hatched part indicates the application liquid L. It should be note that, in this figure, the thicknesses of the layers of the application liquid on the application roller 1001 and the application medium P is depicted relatively larger than the actual thickness, for the purpose of the clear illustration of the state of the application liquid L shown at the time of the application.

In this way, the part of an application medium P to which the liquid has been applied is transferred in the direction indicated by the arrow by the transferring force of the application roller 1001, and, at the same time, the part of the application medium P to which the liquid is not applied is transferred to the contact area between the application medium P and the application roller 1001. By performing this operation continuously or intermittently, the application liquid is applied to the entire surface of the application medium.

Figure 10:
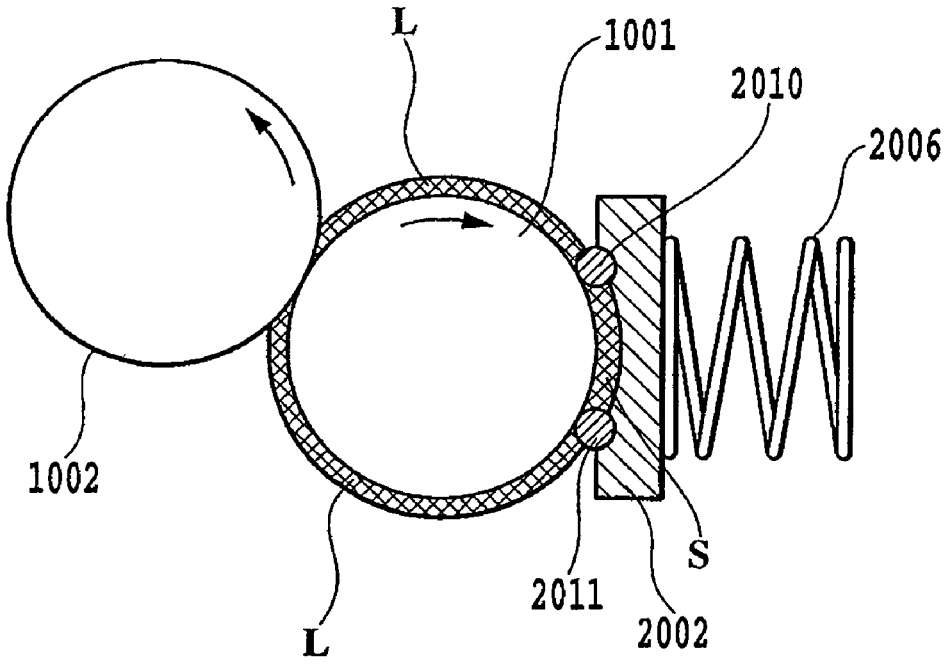
FIG.10 (PRIOR ART)
FIG. 10 is a longitudinal sectional view showing a state where the liquid retention space created by the liquid retention member and the application roller is filled with the application liquid, and the application roller is rotated with no application medium present in the embodiment of the present invention.

Incidentally, the application liquid also acts as a lubricant. Although this will be described later in detail, because the application liquid having been supplied to the surface of the roller is applied to an application medium, only a small amount of the application liquid remains on the roller after the application medium passes the roller. As a result of this, at a point where the application roller again enters the nip area of a cap (the liquid retention member 2001), the application liquid as a lubricant falls short and friction becomes large. Thereby, a paper passing portion of the application roller is abraded. FIG. 9 is a schematic diagram of the paper passing portion (a region having contact with the application medium, i.e., a region where the application medium passes, on the surface of the application roller). Additionally, FIG. 10 is a schematic diagram of a non paper-passing portion (a part which is located on the non-reference side on the application roller, and, for example, on which an application medium of A4 size does not pass, in a case where an application medium of the A4 size is transferred on an application roller capable of applying the application liquid up to A3 size of an application medium)

Figure 21:
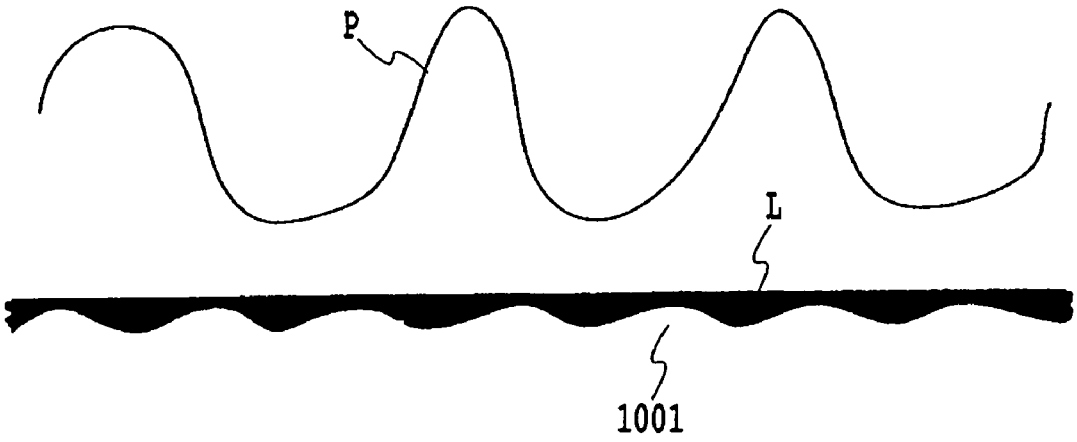
FIG.21 (PRIOR ART)
FIG. 21 is explanatory diagrams for explaining an application process proceeding between an application surface and a surface of the medium in a case where the medium P is a plain paper.
Figure 22:
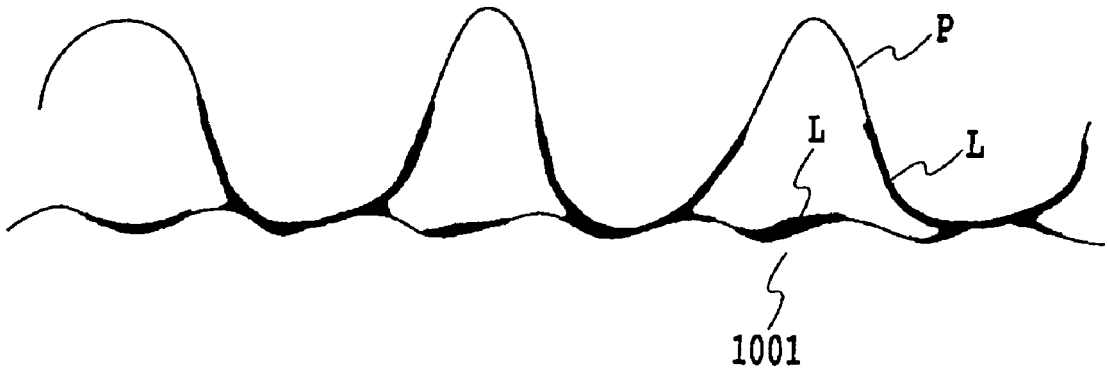
FIG.22 (PRIOR ART)
FIG. 22 is explanatory diagrams for explaining an application process proceeding between an application surface and a surface of the medium in a case where the medium P is a plain paper and FIG. 23 is explanatory diagrams for explaining an application process proceeding between an application surface and a surface of the medium in a case where the medium P is a plain paper.
Figure 23:
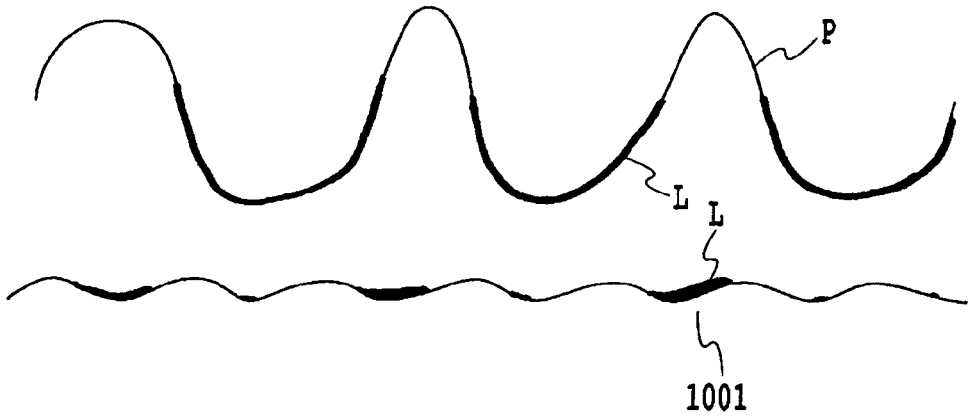
FIG.23 (PRIOR ART)

FIGS. 21 to 23 are explanatory diagrams for explaining an application process proceeding between the application surface and the surface of the medium in a case where the medium P is a plain paper. In these figures, the liquid is expressed by the regions filled in with black.

FIG. 21 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 22 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 23 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

As shown in FIG. 10, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

Finishing Step

Subsequently, after the application operation to the application medium is carried out in the above-mentioned manner, judgment is made as to whether or not the application step may be finished (step S6). In a case where the application step is not finished, the process returns to step S5, and the application operation is repeated until the application is finished on all the parts of the application medium where the application is needed. After the application step is finished, the application roller 1001 is stopped (step S7), and the pump 3007 is also caused to stop driving (step S8). Thereafter, the process proceeds to step S2, and the operations in step S2 to S8 described above are repeated if the application start command is inputted. On the other hand, if the application start command is not inputted, postprocessing, such as a collection operation for collecting the application liquid inside the liquid retention space S and the liquid channels, is performed (step S9), whereby the processes relating to the application are finished.

Note that, the abovementioned collection operation is performed in a way that the application liquid inside the application liquid retention space S and the second channel 3002 are caused to flow into the liquid storage tank 3003 by driving the pump 3007, while the atmosphere communication valve 3005 and the switching valve 3006 are opened. By carrying out this collection operation, volatilization of the application liquid from the liquid retention space S can be perfectly prevented, or at least reduced. Additionally, after the collection operation, the atmosphere communication valve 3005 is closed, and the switching valve 3006 is switched, thereby blocking communication of the first channel 3001 with the atmosphere communication port 3013. Thereby, the storage tank 3003 is separated from the atmosphere. This makes it possible to prevent or reduce volatilization of the application liquid from the storage tank 3003, and at the same time, this makes it possible to perfectly prevent or at least reduce outflow of the application liquid to the outside even if a posture of the device is inclined when the device is carried or transported.

Thus, according to the present embodiment, in the negative pressure system, the supply port is arranged at a position relatively close to the reference, and the collection port is arranged at a position relatively far from the reference. Accordingly, it is possible to disperse abrasion resulting from a negative pressure and abrasion resulting from shortage of the application liquid. That is, the abrasion due to the negative pressure can be restrained from affecting the abrasion due to the shortage or disappearance of the application liquid, which results from of the application of the application liquid to the application medium. Consequently, it is possible to disperse causes of the abrasion of the rollers, such as the application roller and the counter roller, relating to the application. Thereby, it becomes possible to reduce harmful effects on an image due to the abrasion of the rollers, for example, a harmful effect on an image due to uneven application of the application liquid.

Meanwhile, in the present embodiment, in order to restrain the abrasion of the rollers due to the negative pressure from affecting the abrasion of the rollers caused by insufficiency of the application liquid on the surfaces of the rollers, the insufficiency resulting from the application of the application liquid to the application medium, the collection port is arranged at a position relatively far from the reference point as compared with a position at which the supply port is arranged. Therefore, any positional relationship between the collection port and the supply port in relation to the reference point can be accepted as long as the above-mentioned relationship is maintained.

Note that, there is a more favorable positional relationship therebetween in consideration of sizes of application media and the like. For example, in a case where a maximum size of application media supported by the liquid application device is A3, and where a size of application media on which application is performed most frequently is A4, a more favorable positional relation therebetween is as follows. That is, in a case where an application media of the A4 size abuts on (is aligned with) the reference point, it is favorable that the collection port be arranged at a position relatively far from the reference point as compared to an end, which is opposite to the other end abutting on the reference point, of the application media.

Thus, it is preferable that the supply port is arranged on a position of the liquid retention member 2001, opposite to a position of the application roller in a direction orthogonal to the transferring direction, in which the application roller abuts medium of all size. On the other hands, it is preferable that the collection port is arranged on a position of the liquid retention member 2001, opposite to a position of the application roller in a direction orthogonal to the transferring direction, in which the application roller abuts only medium of a part of all size.

Additionally, in cases where application is performed on application media of any size, on a region on the surface of the application roller, where an application medium of a minimum size supported by the liquid application device passes, any application medium inevitably passes regardless of its size. For this reason, in a case where the application medium of the abovementioned minimum size abuts on the reference point, it is also favorable that the collection port be arranged at a position relatively far from the reference point as compared to an end, which is opposite to the other end abutting on the reference point, of the application medium.

Second Embodiment

Next, a main part of another embodiment of the present invention will be described based on FIG. 18.

In the present embodiment, a case is assumed where a reference at the time of transfer is located at the substantial center of the application roller. In the first embodiment, only one side of the application roller is gradually shaved because a recording medium is transferred while abutting on one of end portions of the application roller. In the present embodiment, however, the reference is set at the substantial center. For this reason, the roller is not shaved on only one side, but is shaved symmetrically about the vicinity of the center which is the reference.

In this case, similarly, it is also favorable that the collection port 2005 be arranged at a position relatively far from the reference as compared to a position at which the supply port 2004 is arranged, i.e., the collection port 2005 be arranged at any one or each of both ends of the application roller 1001. If the liquid supply port 2004 is arranged in a vicinity of the center of the application roller 1001 where the reference is arranged, the collection port 2005 is arranged at any one or each of both ends of the application roller 1001. This is because, in any embodiment of the present invention, the numbers of, and formation positions respectively of the supply port 2004 and the collection port 2005 formed in the liquid retention member 2001 are not limited to the abovementioned embodiment.

For example, liquid supply ports can be arranged in both end portions inside a liquid retention space, one liquid collection port or a plurality of liquid collection ports can be formed between both of the liquid supply ports. However, in this case as well, the liquid collection port is arranged at a position farther from the reference point than a position at which the liquid supply port is arranged. Additionally, on the other hand, as shown in FIG. 18, liquid collection ports can be arranged in both end portions inside a liquid retention space, one liquid supply port or a plurality of liquid supply ports may be formed between both of the liquid collection ports. The point is here is that it is only necessary that the liquid, which is retained in the liquid retention space, can flow inside the liquid retention space by arranging the liquid supply port at approximately the same position as the reference, or a position relatively close to the reference, and by arranging the liquid collection port at a position relatively far from the reference.

Other Embodiments

Although, in the first and second embodiments, the liquid retention space S excellent in sealing property (fluid-tight state) is formed by causing the application roller 1001 to abut on the liquid retention member 2001, the present invention is not limited to this configuration. For example, the abovementioned liquid retention space may be formed by causing a chamber described in Japanese Patent Application Laid-open No. 8-058069 (1996) to abut on the circumferential surface of the application roller. That is, any member can be used as a member for forming the liquid retention space as long as the member includes the liquid supply port and the liquid collection port, forms the liquid retention space by abutting on the application roller, and can cause the application liquid to be circulated in, be supplied to, be collected from, and the like, the abovementioned space by means of a negative pressure.

(Embodiment of Inkjet Recording Apparatus)

Figure 19:
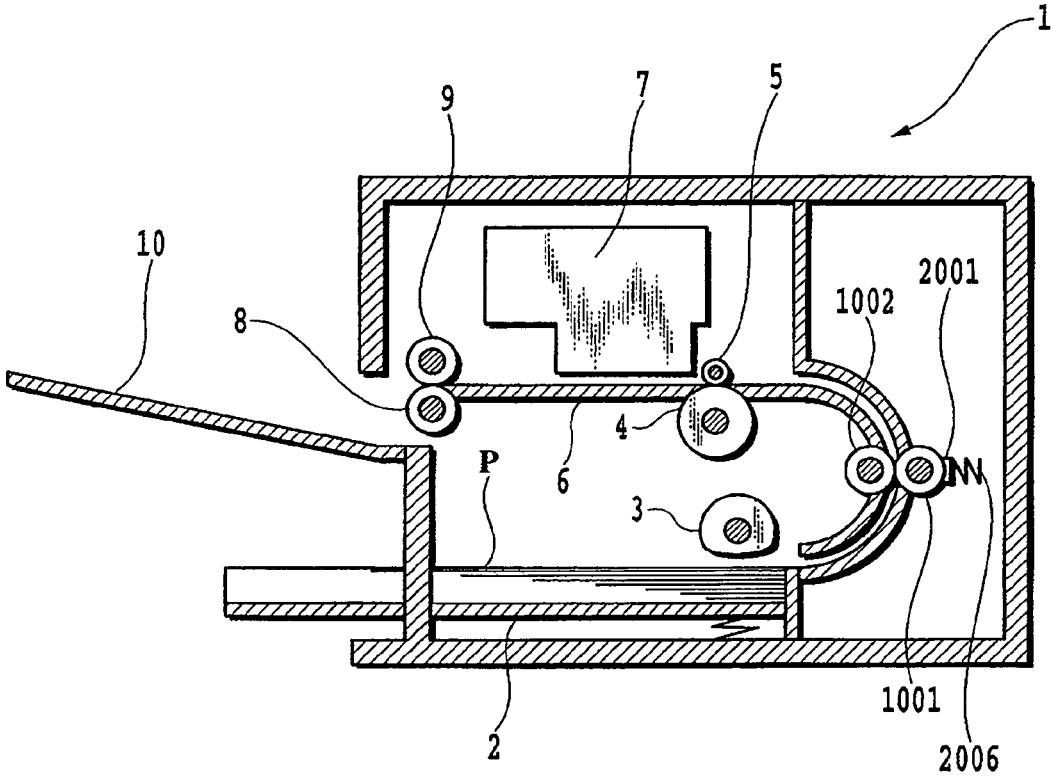
FIG.19 (PRIOR ART)
FIG. 19 is a longitudinal sectional side view showing a schematic configuration of an inkjet recording apparatus in an embodiment of the present invention.

FIG. 19 is a diagram showing a schematic configuration of the inkjet recording apparatus 1 including the application mechanism having almost the same configuration as that of the above liquid application device.

In the inkjet recording apparatus 1, provided is a feed tray 2 on which a plurality of recording media P are stacked, and a semi lunar shaped separation roller 3 separates the recording media P stacked on the feed tray one by one, and feeds each medium to a transfer path. In the transfer path, the application roller 1001 and the counter roller 1002 constituting the liquid application means of the liquid application mechanism are disposed. The recording medium P fed from the feed tray 2 is transferred to the interface between the rollers 1001 and 1002. The application roller 1001 is caused to rotate clockwise in FIG. 19 by the rotation of the roller drive motor, and applies the application liquid on the recording surface of the recording medium P while transferring the recording medium P. The recording medium P to which the application liquid has been applied is sent to the interface between a transfer roller 4 and a pinch roller 5. Subsequently, the counterclockwise (in this figure) rotation of the transfer roller 4 transfers the recording medium P on a platen 6, and moves the medium to a position facing a recording head 7 being an element of recording means. The recording head 7 is an inkjet recording head in which the predetermined number of nozzles for ejecting ink are arranged. While the recording head 7 scans the recording surface in a direction perpendicular to the plane of the drawing sheet, ink droplets are ejected from the nozzles to the recording surface of the recording medium P in accordance with the recorded data to perform recording. An image is formed on the recording medium while the recording operation and the transfer operation by a predetermined feed carried out by the transfer roller 4 are alternately repeated. With the image forming operation, the recording medium P is held between a sheet discharging roller 8 and a sheet discharging spur roller 9 provided downstream of the scanning region of the recording head in the transfer path of the recording media, and is discharged onto a sheet discharged tray 10 by the rotation of the sheet discharging roller 8.

As the inkjet recording apparatus, a so-called full-line type inkjet recording apparatus can be constructed, which performs the recording operation by using a long recording head which has ink-discharging nozzles arranged across the maximum width of the recording media.

The application liquid used in this embodiment is a treatment liquid for promoting the coagulation of pigment when the recording is carried out using an ink which contains pigment as a coloring material. With regard to this embodiment, the treatment liquid is used as the application liquid, so that the treatment liquid is allowed to react with the pigment as a coloring material in the ink ejected to the recording medium, to which the treatment liquid has been applied, to promote the coagulation of pigment. By promoting the coagulation of pigment, it is made possible to achieve the improvement of the recording density. In addition, it is also made possible to reduce or prevent bleeding. Needless to say, the application liquid used in the inkjet recording apparatus is not limited to the above example.

Figure 20:
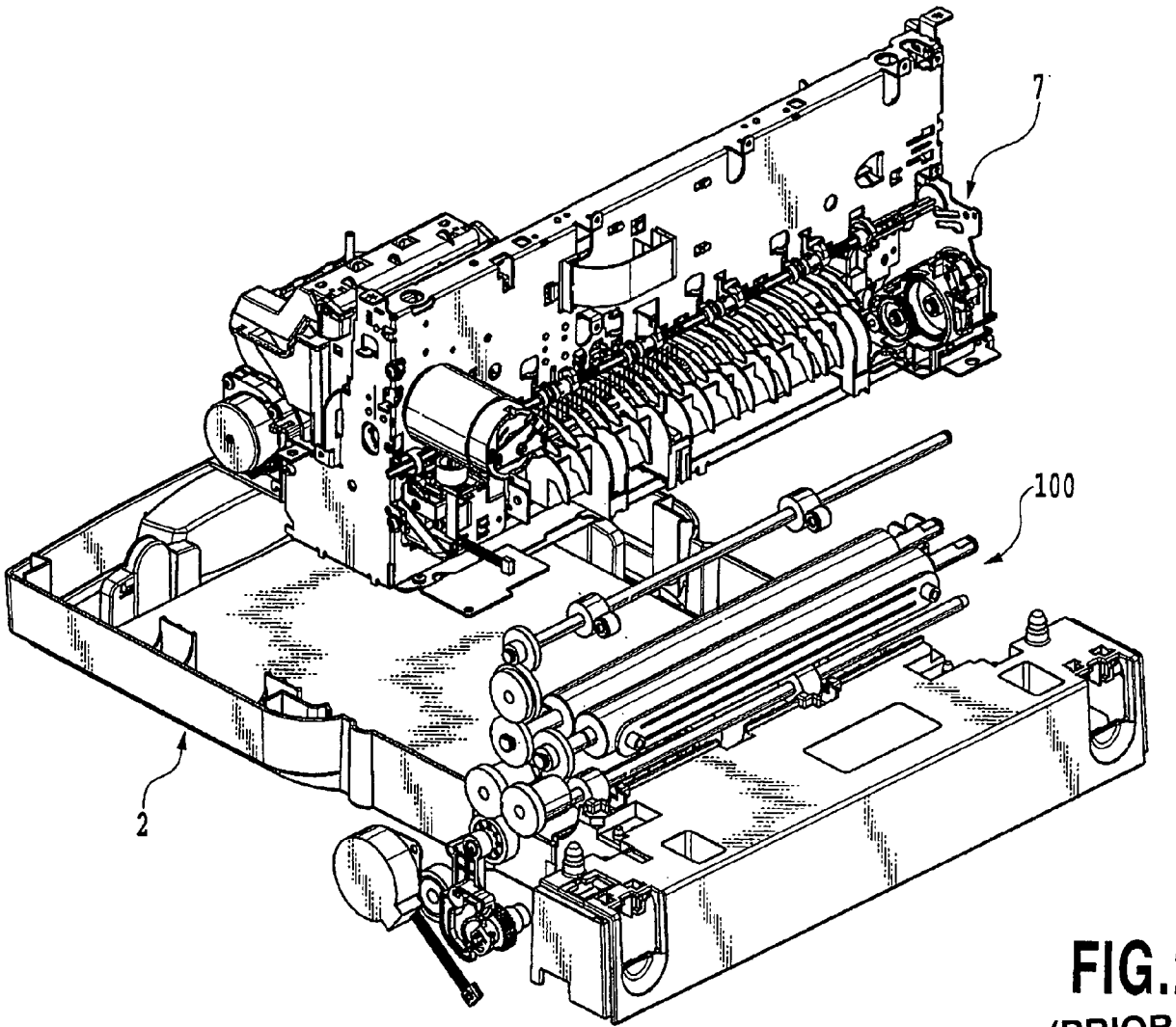
FIG.20 (PRIOR ART)
FIG. 20 is a perspective view showing a main part of the inkjet recording apparatus shown in FIG. 19.

FIG. 20 is a perspective view showing a main part of the above-described inkjet recording apparatus. As shown in this figure, an application mechanism 100 is provided above an edge of the feed tray 2, and the recording means including the recording head 7 is provided above the application mechanism and over a middle portion of the feed tray 2.

In this embodiment, with the liquid being applied to a recording medium, the recording is performed successively onto the part of the recording medium to which the application has been completed. Specifically, with regard to this embodiment, the length of the transfer path from the application roller to the recording head is less than that of the recording medium, and, when the part of the recording medium to which the liquid has been applied reaches the scanning region of the recording head, the application to other part of the recording medium is performed by the application mechanism. The liquid application and the recording are successively performed in different parts of the recording medium every time the recording medium is fed by a predetermined amount. However, when the present invention is applied to recording apparatuses, another mode can be an apparatus which performs recording onto a recording medium after application to the recording medium has been completed, as described in Japanese Patent Application Laid-open No. 2002-96452.

Additionally, in the recording apparatus in the present invention, it is possible to improve the brightness of a medium by causing the liquid application mechanism to apply liquid containing a fluorescent brightening agent. At this time, the recording means used after the liquid is applied is not limited to the inkjet recording method. The effect can be obtained also by adopting other recording methods such as the thermal-transfer method and the electrophotographic method.

In addition, a photosensitizer may be applied before recording in a recording apparatus of the silver-halide photographic type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-352507, filed Dec. 6, 2005, which is hereby incorporated by reference herein in its entirety.

What is claimed is:

1. A liquid application device capable of applying liquid to different size media, comprising:

a transfer unit configured to transfer a medium;

a liquid application unit which is substantially sealed and includes an application member, having an axial direction, for applying liquid to the medium transferred by the transfer unit and a retention member for retaining the liquid in a liquid retention space which is formed by causing the retention member to abut on the application member, wherein the liquid application unit applies the liquid retained in the liquid retention space to the medium via the application member by rotating the application member;

a storage unit configured to store the liquid;

a supply channel for supplying the liquid in the storage unit to the liquid retention space;

a collection channel for collecting the liquid in the liquid retention space into the storage unit;

a supply port which is formed in the retention member and is connected to the supply channel;

first and second collection ports which are formed in the retention member and are connected to the collection channel; and a pump for generating a flow of liquid in a liquid channel including the storage unit, the supplying channel, the liquid retention space, and the collection channel, wherein the pump is provided at the collection channel, and wherein the supply port and the collection ports are arranged along the axial direction of the application member, and wherein the transfer unit transfers a medium so that a center of the medium, in the axial direction of the application member, passes through a position that is closer to the supply port than the collection ports.

2. The liquid application device according to claim 1, further comprising control means for, during application of the liquid to the medium by the liquid application unit, controlling driving of the pump so that circulation of the liquid is generated in the liquid channel.

3. The liquid application device according to claim 1, further comprising a recording head for applying ink to a medium to which the liquid is applied by the liquid application unit.

4. The liquid application device according to claim 3, wherein the liquid includes a component reacting with a component in the ink.

5. A liquid application device capable of applying liquid to different size media, comprising:

a transfer unit configured to transfer a medium;

a liquid application unit which is substantially sealed and includes an application member, having an axial direction, for applying liquid to the medium transferred by the transfer unit and a retention member for retaining the liquid in a liquid retention space which is formed by causing the retention member to abut on the application member, the liquid application unit applies the liquid retained in the liquid retention space to the medium via the application member by rotating the application member;

a supply port which is formed in the retention member and supplies the liquid to the liquid retention space;

first and second discharge ports which are formed in the retention member and discharge the liquid from the liquid retention space; and negative pressure generating means for discharging the liquid in the liquid retention space from the discharge ports while the liquid is applied to the medium by the liquid application unit, wherein the supply port and the discharge ports are arranged along the axial direction of the application member, and wherein the transfer unit transfers a medium so that a center of the medium, in the axial direction of the application member, passes through a position that is closer to the supply port than the discharge ports.

6. The liquid application device according to claim 1, wherein the transfer unit includes a regulating member on which at least one side of a medium along a direction of the transfer is caused to abut.

7. The liquid application device according to claim 1, wherein the first and second collection ports are disposed near opposite ends of the retention member, respectively.

8. The liquid application device according to claim 1, wherein the supply port is disposed between the first and second collection ports.

9. The liquid application device according to claim 1, wherein the supply port is disposed in the vicinity of the center of the retention member in the axial direction.

10. The liquid application device according to claim 9, wherein the first and second discharge ports are disposed near opposite ends of the retention member, respectively.

11. The liquid application device according to claim 9, wherein the supply port is disposed between the first and second discharge ports.

12. The liquid application device according to claim 9, wherein the supply port is disposed in the vicinity of the center of the retention member in the axial direction.

* * * * *